United States Patent [19]

Fontenot

[11] Patent Number: 4,747,303

[45] Date of Patent: May 31, 1988

[54] METHOD DETERMINING FORMATION DIP

[75] Inventor: John E. Fontenot, Houston, Tex.

[73] Assignee: NL Industries, Inc., New York, N.Y.

[21] Appl. No.: 824,186

[22] Filed: Jan. 30, 1986

[51] Int. Cl.[4] ..... E21B 47/00

[52] U.S. Cl. ..... 73/152; 73/151.5; 175/45

[58] Field of Search ..... 73/151, 151.5, 152; 175/40, 45, 50, 61; 299/1; 364/422

[56] References Cited

U.S. PATENT DOCUMENTS

| | | | |
|---|---|---|---|
| 2,930,137 | 3/1960 | Arps | 73/151 |
| 3,077,670 | 2/1963 | Waters | 73/151 |
| 3,186,222 | 6/1965 | Martin | 73/151 |
| 3,255,353 | 6/1966 | Scherbatskoy | 73/151 |
| 3,626,482 | 12/1971 | Quichaud et al. | 73/151 X |
| 4,324,297 | 4/1982 | Denison | 175/45 |
| 4,445,578 | 5/1984 | Millheim | 175/45 |
| 4,452,075 | 6/1984 | Bockhorst et al. | 73/151 |
| 4,479,564 | 10/1984 | Tanguy | 175/45 X |

*Primary Examiner*—Michael J. Tokar
*Assistant Examiner*—Kevin D. O'Shea
*Attorney, Agent, or Firm*—Browning, Bushman, Zamecki & Anderson

[57] ABSTRACT

The inclination and slope of a bedding plane are determined from oriented measurements of the bending moment generated as a bit encounters and passes completely through the interface between two dissimilar formations. These moments are distinguishable from moments generated by gravity, interaction of the bit and the formation, and interaction of the drill string with the borehole. Preferably, determination of the bedding slope and direction is accomplished by downhole data processing.

31 Claims, 2 Drawing Sheets

FIG. 1
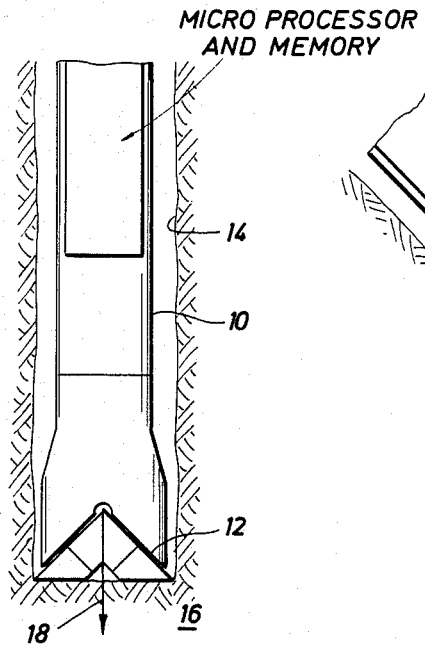
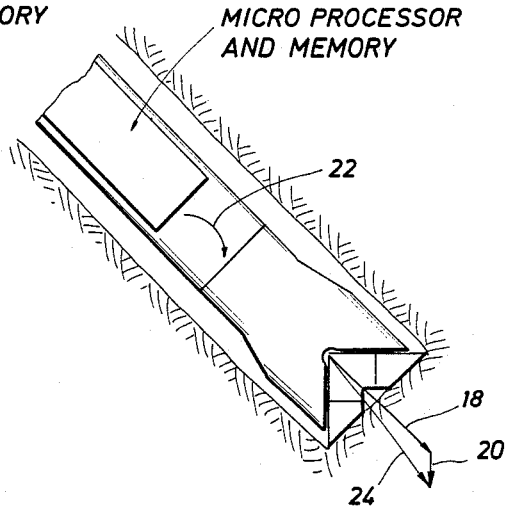
FIG. 2
FIG. 3
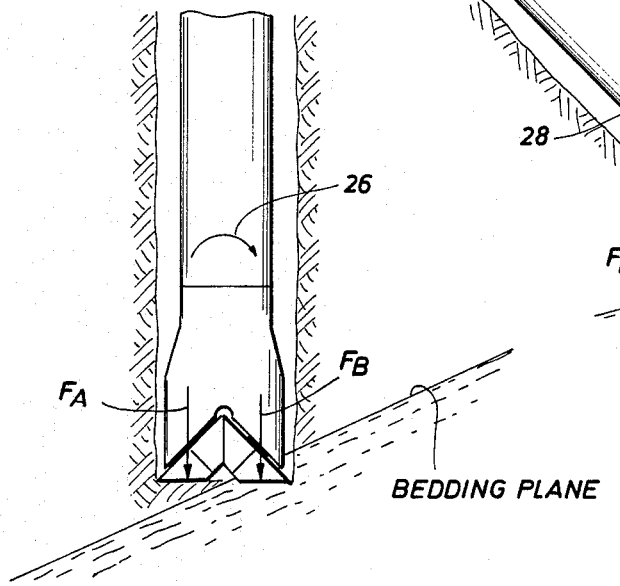
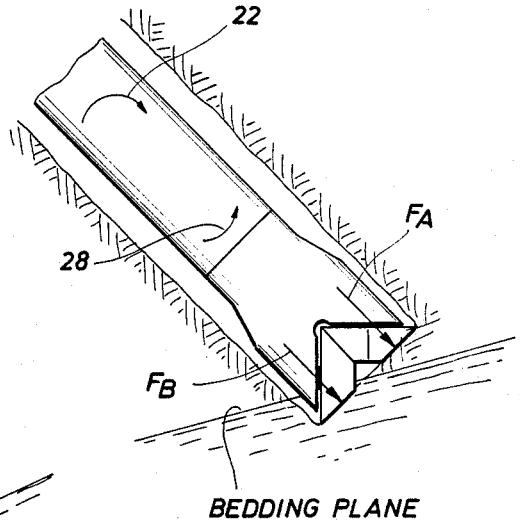
FIG. 4

DRILLING RATE SENSOR 70
DEPTH SENSOR 60
TELEMETRY RECEIVER 64
DATA PROCESSOR 66
RECORDER 68

DATA STORAGE
DATA PROCESSING
AZIMUTH SENSOR
INCLINATION SENSOR
GAMMA SENSOR
NEUTRON POROSITY SENSOR
γ-γ DENSITY SENSOR
RESISTIVITY SENSOR
ACCELEROMETER SENSOR
BIT MECHANICS SENSOR
ORIENTED MAGNETOMETER SENSOR
34
36
38
40
42
46
32
48
50
52
54
56
58
30
62
10
34
32
16
14
12

METHOD DETERMINING FORMATION DIP

BACKGROUND OF THE INVENTION

1. Field of the Invention

The present invention relates to a method employing measurement of magnitude and direction of the bending moments near a drill bit to estimate formation dip at an interface.

2. Description of the Prior Art

The dip of a formation is useful to geologists and reservoir engineers in defining the type, size and the profile of a reservoir. Further, this information is useful for explaining directional drilling tendencies, for correlating lithology, and for detecting faults in a formation. The angle (magnitude) and direction of the formation dip is presently measured by passing a hard wired, wireline device through a completed hole. Although measurements made by this manner provide useful information, they are of no help to the drilling engineer during the drilling operation.

Because the dip of a formation can affect the side forces acting on a bit while drilling, knowledge of the formation dip would be most useful to the drilling engineer particularly, when he is attempting directional drilling. The present invention provides a method which is useful for predicting or determining the magnitude (angle) and direction of formation dip by measuring the magnitude and direction of bending moments on the bit while the drilling operation continues. Measurements of the bending moment are made in two orthogonal planes providing both magnitude and direction for the bending moments. This is accomplished by monitoring the direction of the two orthogonal planes by using oriented magnetometer measurements.

U.S. Pat. No. 4,445,578 to Millheim discloses are apparatus and method for providing measurement of the side force on a drill bit during drilling, thus permitting corrective action to be taken immediately in the drilling operation. The Millheim system includes means to detect the side thrust or force on a bit and the force on the deflection means of a downhole motor. This system provides for measuring the magnitude of the force on a downhole stabilizer. While Millheim discloses means for measuring various forces acting near the drill bit and correcting the drilling parameters in response thereto, he does not disclose or suggest any way in which these measurements can be used to make a determination of the formation dip. The side forces at the bit or at a sub are measured by using multiple strain gauges or load cells and transmitting the measurements back to the surface. The sampling rate is limited by the transmission rate. The measured forces are then used to determine the directional tendencies of the hole. The orientation of the side forces are not measured, but periodic surveys of the hole are made to determine its direction during rotary drilling.

U.S. Pat. No. 4,324,297 to Denison discloses a method and apparatus for measuring the weight on bit, the bending stress near the bit, and the orientation of these stresses. These measurements are sent to the surface by wire line telemetry or other high data rate transmission means including mud pulse telemetry. The data is processed at the surface to compare the measured side forces with a drilling model for controlling the directional tendencies by adjusting weight on bit. This patent teaches the use of oriented bending moments for directional control. In order to effectively implement the teachings of this patent it is necessary to have a high data rate telemetry system. However, this patent does not mention anything about measuring the formation dip or how interaction with a formation face will affect the steering or the possibility of utilizing downhole processing to avoid transmission rate limitations and associated problems.

SUMMARY OF THE INVENTION

The present invention utilizes bending moment measurements taken by a bit mechanics sensor coupled with an oriented magnetometer measurement of borehole heading to determine the magnitude (angle) and direction of the dip of a formation encountered during a drilling operation. When the bit encounter a change from one formation to another, the drilling rate should change. If the formation dip is normal to the axial direction of the bit, then the direction and magnitude of the bending moment should not change. However, if the bit encounters a new formation at an angle other than ninety degrees to the bit axis, one side of the bit should see the new formation sooner than the other side. Accordingly, a detectable bending moment should be generated at this point with the size and direction of the bending moment indicating the magnitude and direction of formation dip.

BRIEF DESCRIPTION OF THE DRAWINGS

The present invention will be described by way of example with reference to the accompanying drawings in which:

FIG. 1 is a diagrammatic view of a straight borehole in homogeneous rock;

FIG. 2 is a diagrammatic view of a directional borehole in homogeneous rock;

FIG. 3 is a diagrammatic view of a straight borehole encountering a formation change;

FIG. 4 is a diagrammatic view of a directional borehole encountering a formation change;

DESCRIPTION OF PREFERRED EMBODIMENTS

Figures 5, 6:
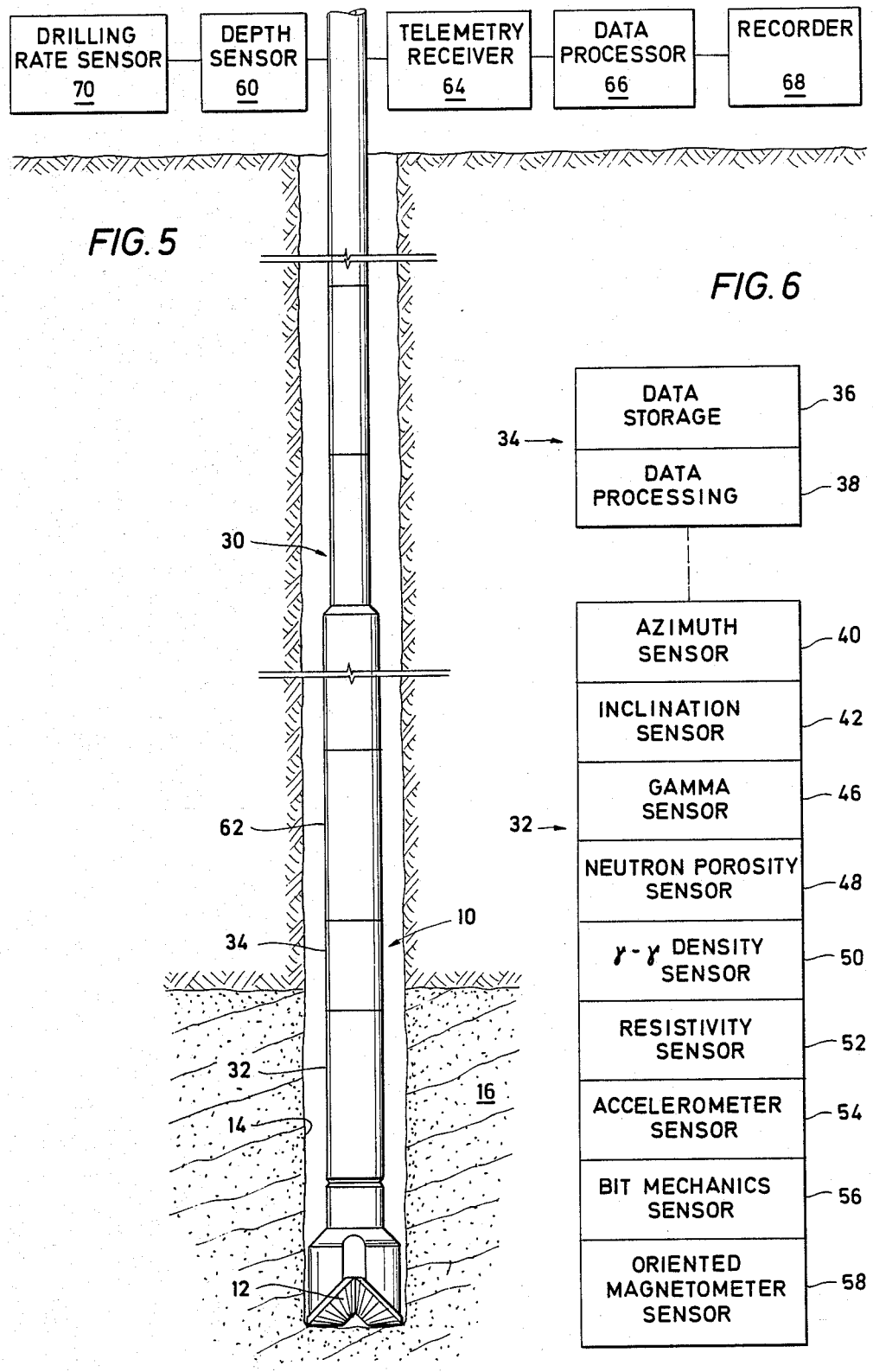
FIG. 5 is a diagrammatic view of a portion of a typical drill string having a bottomhole assembly in accord with the present invention disposed on its lower end.
FIG. 6 is a schematic illustration of a microprocessor and a plurality of sensors disposed in a bottomhole assembly in accord with the present invention.

Until now, formation dip (magnitude and direction) has only been measured by using a wireline device after the borehole has been drilled. However, the information on formation dip is extremely important to geologists and reservoir engineers in order to define reservoir type, size and shape. Therefore, it is important that this information be made available as soon as possible and preferably without interrupting the drilling operation.

Referring now to FIGS. 1 and 2, a bottom hole assembly 10, including a drill bit 12, sensor sub 32, equipment sub 34 and telemetry sub 62, is shown in the bottom of a borehole 14 drilled in a homogeneous rock formation 16. In this situation, as one would expect, the average bending moment would have no preferential direction; in other words, there would be no net tendency of the bit to drill laterally. The bit force would be substantially axial and vertical as noted by the arrow 18.

In the directional hole of FIG. 2, the borehole 14 is at an angle other than vertical. In this instance the bit would have a side force whose magnitude and direction would be dependent upon the forces measured on the bit due to gravitational effects and axial forces in the drill string due to tension applied at the surface (hook load). Thus, the total bit force, represented by arrow 24, would have a gravity component 20 dependent upon the bit moment 22 and an axial component 18. As in the case of FIG. 1, the directional hole of FIG. 2 is assumed to be drilling through homogeneous rock.

FIGS. 3 and 4 demonstrate the concept of the present invention which notes that there will be a near bit bending moment generated when the bit traverses a bedding plane between formations. It will be appreciated that the forces encountered by opposite sides of the bit will be different because each will be engaging rock having different drilling characteristics. The presence of the bedding plane or interface may be detected by use of a downhole accelerometer 54. In both instances, one side of the bit, noted by the arrow Fa, will be drilling in the original formation while the opposite side of the bit, noted by the arrow Fb, will be drilling in a different or second formation. This will cause bit moments 26, 28 to be generated. When the bit encounters the change from one formation to another, the drilling rate changes. If, however, the bedding plane is normal to the actual direction of the bit, one would not expect any directional effects on the bit, and hence the direction of existing bending moments will not change. However, if the bit encounters a new formation at an angle other than ninety degrees to the bit axis, one side of the bit will see the new formation sooner than the other side. Since the bit is drilling in rock having two different drilling characteristics, one would expect a bending moment to be generated at this point. The size and direction of the bending moment would be indicative of the magnitude of the formation dip and its direction. In this way, the bending moments measured by a bit mechanics sensor 56 coupled with readings from oriented magnetometer sensors 58 can be used to develop estimates for formation dip and its direction.

The invention recognizes that drilling a well is not a smooth boring operation. There is an almost continual series of bit bending moments being generated as the bit advances through the formation. These moments can be caused by interaction between the bit and the formation. Other moments can be generated by gravitational effects on the drill string 30, the mechanics of the drill string 30 itself which acts, in many ways, as a giant compression spring, and the interaction of the drill string 30 with the borehole 14. However, these moments are of such nature as to be readily identifiable and distinguishable. The signals generated by these moments can be treated as "noise" or "chatter" and appropriately filtered. The present invention focuses on the significant sustained moment generated as the bit passes through a formation interface.

In order to determine the formation dip, it is necessary to know the direction of drilling, including both azimuth and inclination which are determined by a conventional azimuth sensor 40 and a conventional inclination sensor 42, respectively. Additionally, to locate the formation dip, the depth of the bit is determined by a conventional depth sensor 60. The bit bending moment and its direction are sampled frequently, approximately once every inch of hole drilled. The rate of sampling required depends upon the drilling rate which is determined by a conventional drilling rate sensor 70. When the drilling rate changes, indicating a change in formation character, the bending moment data taken during the change in drilling rate is analyzed to determine the formation dip, if other than normal to the direction of drilling. As an alternative, a normalized drilling rate may be employed to determine the presence of the formation interface. As a still further alternative to the drilling rate as an indicator of formation change, a measurement-while-drilling formation logging device, e.g., a gamma ray sensor 46, a neutron porosity sensor 48, a gamma-gamma density sensor 50 or resistivity sensor 52, may be used. The formation logging device is usually located some distance above the bit. This alternative method, of necessity, delays the determination of formation dip until the formation change has been identified by the formation logging device. It is possible to accomplish all of these measurements with state-of-the-art downhole equipment disposed in a downhole sensor sub 32.

In is proposed in the present invention that the downhole equipment sub 34 include a microprocessor 38 and memory 36 so that the occurrence and ending of the bending moments, together with bit orientation and inclination and the presence of the formation interface, can be readily and rapidly determined without sending all the needed data to the surface. This allows a downhole sampling range independent of the downhole-to-surface transmission rate. While no sampling rate is specified, it would have to be high enough to get measurements for every inch or so of borehole. The rate of sampling would be dependent upon drilling rate. The data on the formation interface could be both stored downhole, for subsequent readout at the surface when the drilling string is withdrawn for bit replacement, or transmitted to the surface using conventional telemetry transmitter 62 and receiver 64. This would not require a high transmission rate as the data would have been processed and only the resulting determination transmitted. The value of formation dip determined may be compared with other known geological survey information in surface data processor 66 and/or recorded with recorded 68.

The foregoing disclosure and description of the invention is illustrative and explanatory thereof, and various changes in the method steps may be made within the scope of the appended claims without departing from the spirit of the invention.

What is claimed is:

1. A method for determining the magnitude (angle) and direction of the dip of a formation interface encountered by a bit while drilling and without interrupting the drilling operations, said method comprising the steps of:

measuring near bit bending moments generated when said bit encounters said formation interface until said bit passes completely therethrough;

measuring the direction of said bit bending moments while said near bit moments are being generated;

measuring the inclination and direction of the wellbore at the location of the formation interface; and determining from said measurements the magnitude (angle) and direction of the formation dip.

2. A method according to claim 1 further comprising the step of:

detecting the presence of the interface by use of a downhole accelerometer whose readings are indicative of a change in formation character.

3. A method according to claim 1 wherein said near bit moments are measured using a bit mechanics sensor.

4. A method according to claim 1 wherein said direction of said bit bending moments are measured by oriented magnetometers.

5. A method according to claim 1 wherein said determination of magnitude and direction of a formation interface is done by a microprocessor located downhole in an equipment sub of a drill string.

6. A method according to claim 5 wherein said microprocessor stores formation dip information downhole and causes it to be transmitted to the surface.

7. A method according to claim 1 further comprising the step of:

filtering out near bit moments caused by gravity, a drill string mechanics, and interaction of the drill string with the borehole.

8. A method according to claim 1 further comprising the step of:

measuring the depth of said bit and inclination and direction of the wellbore where said interface is detected.

9. A method according to claim 1 further comprising the step of:

comparing said determination with known geological survey information.

10. A method according to claim 1 further comprising the step of:

determining the presence of the interface by use of a downhole measurement-while-drilling formation evaluation sensor.

11. A method according to claim 10 wherein said formation evaluation sensor is a gamma ray sensor.

12. A method according to claim 10 wherein said formation evaluation sensor is a neutron porosity sensor.

13. A method according to claim 10 wherein said formation evaluation sensor is a gamma-gamma density sensor.

14. A method according to claim 10 wherein said formation evaluation sensor is a formation resistivity sensor.

15. A method according to claim 10 wherein said formation evaluation sensor includes a combination of sensor devices.

16. A method according to claim 1 further comprising the step of:

determining the presence of the interface wherein said interface is detected through a normalized drilling rate measured at the surface.

17. A system for determining the dip of a formation interface encountered in a drilling operation comprising:

means to measure a near bit bending moment generated by a bit encountering and passing through said interface;

means to measure the orientation of said bit bending moment while said moment is present;

means to measure the inclination and orientation of the wellbore at the location of the interface; and means to determine the dip of a formation interface from said near bit bending moment measurements and said orientation and inclination measurements.

18. A system according to claim 17 further comprising:

means to filter out near bit moments caused by gravity, drill string mechanics and interfaction of the drill string with the borehole.

19. A system according to claim 17 further comprising:

means to detect the presence of the formation interface.

20. A system according to claim 19 wherein said means to detect the presence of the formation interface is a downhole accelerometer sensitive to the formation characteristics.

21. A system according to claim 19 wherein said means to detect the presence of the formation interface is a downhole formation evaluation sensor.

22. A system according to claim 21 wherein said downhole formation evaluation sensor is a gamma ray sensor.

23. A system according to claim 21 wherein said downhole formation evaluation sensor is a neutron porosity sensor.

24. A system according to claim 21 wherein said downhole formation evaluation sensor is a gamma-gamma density sensor.

25. A system according to claim 21 wherein said downhole formation evaluation sensor is a formation resistivity sensor.

26. A system according to claim 21 wherein said downhole formation evalutation sensor is formed by a combination of sensor devices.

27. A system according to claim 17 wherein said means to measure the orientation of said bit bending moments comprise oriented magnetometers.

28. A system according to claim 17 wherein said means to determine presence and dip of a formation interface comprises a microprocessor located downhole in an equipment sub.

29. A system according to claim 28 wherein said microprocessor further comprises memory storage means.

30. A system according to claim 28 wherein said microprocessor further controls means to transmit to the surface information about the formation interface.

31. A system according to claim 19 wherein said means to detect the presence of the formation interface utilizes a measurement system that provides a normalized drilling rate.

* * * * *

UNITED STATES PATENT AND TRADEMARK OFFICE

CERTIFICATE OF CORRECTION

PATENT NO. : 4,747,303

DATED : May 31, 1988

INVENTOR(S) : John E. Fontenot

It is certified that error appears in the above-identified patent and that said Letters Patent is hereby corrected as shown below:

In Column 5, line 15, delete "a".

In Column 6, line 11, delete "interfaction" and insert therefor --interaction--.

In Column 6, line 37, delete "evalutation" and insert therefor --evaluation--.

Signed and Sealed this

Thirteenth Day of December, 1988

*Attest:*

*Attesting Officer*

DONALD J. QUIGG

*Commissioner of Patents and Trademarks*